US007901742B2

(12) United States Patent
Shirono et al.

(10) Patent No.: US 7,901,742 B2
(45) Date of Patent: Mar. 8, 2011

(54) METHOD FOR FORMING METAL OXIDE FINE PARTICLE LAYER ON CONDUCTIVE SUBSTRATE

(75) Inventors: Katsuhiro Shirono, Kitakyushu (JP); Takaki Mizuno, Kitakyushu (JP); Tsuguo Koyanagi, Kitakyushu (JP)

(73) Assignee: JGC Catalysts and Chemicals Ltd., Kawasaki-shi (JP)

( * ) Notice: Subject to any disclaimer, the term of this patent is extended or adjusted under 35 U.S.C. 154(b) by 168 days.

(21) Appl. No.: 12/305,521

(22) PCT Filed: Jun. 18, 2007

(86) PCT No.: PCT/JP2007/062207

§ 371 (c)(1),
(2), (4) Date: Dec. 18, 2008

(87) PCT Pub. No.: WO2007/148642

PCT Pub. Date: Dec. 27, 2007

(65) Prior Publication Data

US 2009/0226627 A1 Sep. 10, 2009

(30) Foreign Application Priority Data

Jun. 19, 2006 (JP) ..... 2006-169258

(51) Int. Cl.
*B05D 1/06* (2006.01)

(52) U.S. Cl. ..... 427/474; 427/458; 427/472; 427/473

(58) Field of Classification Search ..... 427/458, 427/472, 473, 474

See application file for complete search history.

(56) References Cited

U.S. PATENT DOCUMENTS

| | | | | |
|---|---|---|---|---|
| 5,422,062 | A | 6/1995 | Kinoshita et al. | |
| 5,604,174 | A * | 2/1997 | Friedman et al. | 502/439 |
| 6,503,382 | B1 * | 1/2003 | Bartlett et al. | 205/67 |
| 2002/0005355 | A1 | 1/2002 | Schuh et al. | |

FOREIGN PATENT DOCUMENTS

| | | | |
|---|---|---|---|
| EP | 0293981 | A2 | 12/1988 |
| JP | 58-081995 | * | 5/1983 |
| JP | 58081995 | A | 5/1983 |
| JP | 59213442 | A | 12/1984 |
| JP | 62036080 | A | 2/1987 |
| JP | 6465299 | A | 3/1989 |
| JP | 1299558 | A | 12/1989 |
| JP | 2002100416 | A | 4/2002 |
| JP | 2002121697 | A | 4/2002 |
| JP | 2002147218 | A | 5/2002 |
| JP | 2002254866 | A | 9/2002 |
| JP | 2004169111 | A | 6/2004 |
| WO | 9915715 | A2 | 4/1999 |

OTHER PUBLICATIONS

Abstract, JP 2001-517738, published Oct. 9, 2001, entitled "Coated Products", inventors: Schuh et al. (1 p.).

* cited by examiner

*Primary Examiner* — Frederick J Parker
(74) *Attorney, Agent, or Firm* — The Webb Law Firm

(57) ABSTRACT

A method for forming a metal oxide fine particle layer, by which a metal oxide fine particle layer having uniformity and excellent in adhesion, abrasion resistance, strength, etc. can be formed easily compared with the conventional plating method, CVD method, liquid coating method, electrodeposition method or the like. The method comprises immersing a conductive substrate in a dispersion of metal oxide fine particles and fibrous fine particles and applying a direct-current voltage to the conductive substrate and the dispersion. The fibrous fine particles have a length (L) of 50 nm to 10 μm, a diameter (D) of 10 nm to 2 μm and an aspect ratio (L)/(D) of 5 to 1,000. The content of the fibrous fine particles in the dispersion is in the range of 0.1 to 20% by weight in terms of solids content, based on the metal oxide fine particles.

7 Claims, No Drawings

METHOD FOR FORMING METAL OXIDE FINE PARTICLE LAYER ON CONDUCTIVE SUBSTRATE

TECHNICAL FIELD

The present invention relates to a method form forming a metal oxide fine particle layer on a surface of a conductive substrate.

More particularly, the invention relates to a method for forming a metal oxide fine particle layer, by which a metal oxide fine particle layer having uniformity and excellent in adhesion, abrasion resistance, strength, etc. can be formed extremely easily as compared with conventional plating method, CVD method, liquid coating method or the like. Especially, the invention relates to a method capable of forming a metal oxide fine particle layer having uniformity and excellent in adhesion, abrasion resistance, strength, etc. on a surface of a molded product of complicated shape, such as a honeycomb substrate having a large number of holes of fine openings, though it is difficult to form the layer on such a substrate by the conventional methods.

BACKGROUND ART

As molded catalysts, honeycomb type catalysts have been known in the past, and they are known as catalysts for removing nitrogen oxide from coal or heavy oil exhaust gas ($NO_x$ removal catalysts), catalysts for removing nitrogen oxide from automobile exhaust gas, catalysts for removing particulate substances from automobile exhaust gas (Japanese Patent Laid-Open Publication No. 147218/2002, patent document 1), sulfide oxidation catalysts, fuel treating catalysts for fuel cells (e.g., methanation catalysts), deodorization catalysts (Japanese Patent Laid-Open Publication No. 299558/1989, patent document 2), etc.

The honeycomb type catalysts mainly include a honeycomb type catalyst obtained by kneading an oxide powder containing a catalyst component and extrusion molding the kneadate and a honeycomb type catalyst obtained by forming a carrier layer on a metal or ceramic honeycomb substrate and allowing the layer to support a catalyst component or forming a catalyst layer on the honeycomb substrate surface.

In the case of the former catalyst, strain or deflection is liable to occur, or when it is dried or calcined, cracking is liable to occur, and therefore, it is difficult to obtain a large honeycomb catalyst. In the case of the latter catalyst, it is difficult to form a carrier layer and/or a catalyst layer having excellent adhesion on the metal or ceramic honeycomb substrate surface.

On this account, in the former case where an oxide powder is used, use of a fibrous substance such as glass fiber or organic fiber has been carried out (Japanese Patent Laid-Open Publication No. 213442/1984 (patent document 3), Japanese Patent Laid-open Publication No. 36080/1987 (patent document 4)). In this method, strain, deflection, cracks, etc. can be reduced to a certain extent, but it is difficult to remove them completely, and in order to enhance productivity, further improvement has been desired.

In the latter case where a carrier layer is formed, it has been proposed to form protrusions on the honeycomb substrate surface (Japanese Patent Laid-Open Publication No. 169111/2004 (patent document 5)). Also in this method, however, adhesion of the carrier layer or the catalyst layer is insufficient, and when the catalyst is used over a long period of time, there occurs problems of lowering of catalytic performance and occurrence of separation of the carrier layer or the catalyst layer.

As a method for generally forming a fine particle layer on a substrate of a simple structure such as a flat plate substrate, a photoelectric conversion element for photovoltaic cell obtained by depositing semiconductor fine particles in a layer form on a conductive substrate by electrophoresis has been disclosed (Japanese Patent Laid-Open Publication No. 100416/2002 (patent document 6)).

Further, a method for producing an electrodeposited grindstone having a high-density abrasive grain layer by elelctrodepositing metal oxide-coated diamond abrasive grains on a substrate has been disclosed (Japanese Patent Laid-Open Publication No. 254866/2000 (patent document 7)).

Moreover, a fluororesin-containing porous body for gas diffusion electrode, which is obtained by depositing fluororesin fine particles as gas diffusion electrode materials on a surface of a conductive substrate by electrophoresis, has been disclosed (Japanese Patent Laid-Open Publication No. 121697/2002 (patent document 8)).

Patent document 1: Japanese Patent Laid-Open Publication No. 147218/2002

Patent document 2: Japanese Patent Laid-Open Publication No. 299558/1989

Patent document 3: Japanese Patent Laid-Open Publication No. 213442/1984

Patent document 4: Japanese Patent Laid-Open Publication No. 36080/1987

Patent document 5: Japanese Patent Laid-Open Publication No. 169111/2004

Patent document 6: Japanese Patent Laid-Open Publication No. 100416/2002

Patent document 7: Japanese Patent Laid-Open Publication No. 254866/2002

Patent document 8: Japanese Patent Laid-Open Publication No. 121697/2002

DISCLOSURE OF THE INVENTION

Problem To Be Solved By The Invention

The above methods, however, are restricted in uses, and adhesion of the fine particle layer to the substrate, abrasion resistance, strength, etc. are sometimes insufficient. In particular, it is difficult to form the layer on a substrate having a complicated structure, such as a honeycomb substrate, and even if the layer is formed, there are problems in adhesion, abrasion resistance, strength, etc.

Means To Solve The Problem

The present inventors have earnestly studied in view of the above problems, and as a result, they have found that when a metal honeycomb substrate is immersed in a dispersion containing metal oxide fine particles and fibrous fine particles and then a direct-current voltage is applied to the substrate and the dispersion, the metal oxide fine particles are uniformly deposited in a layer form on the metal honeycomb substrate and exhibit excellent adhesion. Thus, the present inventors have achieved the present invention.

In the patent document 8, it is disclosed that a fibrous substance is brought into close contact with an electrode and electrodeposited thereon in order to reinforce the electrode, but what kind of fibrous substance is used is not described.

That is to say, the constitutional requisites of the present invention are as follows.

(1) A method for forming a metal oxide fine particle layer on a conductive substrate, comprising immersing a conductive substrate in a dispersion of metal oxide fine particles and fibrous fine particles and applying a direct-current voltage to the conductive substrate and the dispersion.

(2) The method for forming a metal oxide fine particle layer of (1), wherein the fibrous fine particles have a length (L) of 50 nm to 10 μm, a diameter (D) of 10 nm to 2 μm and an aspect ratio (L)/(D) of 5 to 1,000.

(3) The method for forming a metal oxide fine particle layer of (1) or (2), wherein the content of the fibrous fine particles in the dispersion is in the range of 0.1 to 20% by weight in terms of solids content, based on the metal oxide fine particles.

(4) The method for forming a metal oxide fine particle layer of any one of (1) to (3), wherein the dispersion further contains colloidal particles having a mean particle diameter of 2 to 300 nm.

(5) The method for forming a metal oxide fine particle layer of (4), wherein the content of the colloidal particles is in the range of 0.1 to 20% by weight in terms of solids content, based on the metal oxide fine particles.

(6) The method for forming a metal oxide fine particle layer of any one of (1) to (5), wherein the metal oxide fine particles comprise an oxide of one or more metals selected from the group consisting of Mg, Ca, Ba, La, Ce, Ti, Zr, V, Cr, Mo, W, Mn, Zn, Al, Si, P and Sb and have a mean particle diameter of 10 nm to 5 μm.

(7) The method for forming a metal oxide fine particle layer of any one of (1) to (6), wherein the fine particle layer has a thickness of 10 nm to 1 mm.

(8) The method for forming a metal oxide fine particle layer of any one of (1) to (7), wherein the dispersion medium of the dispersion is one or more substances selected from water, alcohols, ketones, glycols and organic acids.

(9) The method of any one of (1) to (8), wherein the dispersion has a solids concentration of 1 to 30% by weight.

EFFECT OF THE INVENTION

According to the present invention, a method for forming a fine particle layer composed of metal fine particles or metal oxide fine particles on a surface of a conductive substrate extremely easily can be provided.

The fine particle layer formed has high adhesion to the conductive substrate and is excellent in abrasion resistance, strength, etc., so that it can be favorably used as an adsorbent, a catalyst, a film material of, for example, a substrate with a dielectric film, a substrate with an insulating film, a substrate with a conductive film, an electrode film or an electrolyte film, or the like.

BEST MODE FOR CARRYING OUT THE INVENTION

The method for forming a metal oxide fine particle layer on a conductive substrate according to the invention is described in detail hereinafter.

The method for forming a metal oxide fine particle layer on a conductive substrate according to the invention comprises immersing a conductive substrate in a dispersion of metal oxide fine particles and fibrous fine particles and applying a direct-current voltage to the conductive substrate and the dispersion.

Conductive Substrate

The substrate for use in the invention is not specifically restricted provided that it has electrical conduction properties, and a hitherto publicly known substrate is employable.

Specifically, substrates composed of metals such as aluminum, tin and various stainless steels are employable, and examples of their shapes include flat plate, wavy plate, tube and honeycomb. In addition to the substrate composed of a metal alone, a conductive substrate obtained by forming a conductive film on an insulating substrate such as a substrate composed of a ceramic, such as glass, titanium oxide, cordierite, silicon oxide or silicon nitride, is also employable. Examples of the conductive films on the insulating substrate include films of metals such as aluminum, tin, gold, silver and copper, and films composed of metal oxides having electrical conduction properties, such as tin-doped indium oxide (ITO) and antimony-doped tin oxide (ATO).

If the honeycomb type conductive substrate is used among them, a honeycomb type catalyst or the like having a fine particle layer excellent in strength, abrasion resistance, etc. can be obtained extremely easily without occurrence of cracks, as compared with a honeycomb type catalyst or the like obtained by a hitherto publicly known molding method.

The honeycomb type conductive substrate for use in the invention has a section having an outer diameter of 20 to 200 mm, and preferably has an opening of 1 to 30 mm, a wall thickness of 0.01 to 5 mm and a length of 30 to 1000 mm.

A substrate having a small outer diameter has a small number of cells, and usage of such a substrate is restricted. If the diameter is too large, the metal oxide fine particle layer is sometimes formed ununiformly. When the outer diameter is intended to be made larger, it is sometimes advantageous that a substrate having a diameter of an appropriate size is laminated and used.

If the opening is too small, clogging sometimes occurs after a metal oxide fine particle layer is formed. Moreover, such a substrate is unsuitable for a reaction of a high superficial velocity in a column, and an effect attributable to the use of the honeycomb catalyst is not sufficiently obtained.

If the opening is too large, blow-by of a reaction gas occurs when such a substrate is used for a catalyst or the like, and satisfactory catalytic performance is not obtained occasionally.

Although the shape of the opening is not specifically restricted, the opening has a shape of a circle, an oval, a rectangle or the like, and it generally means a diameter of a cell adopted. In the case of a circle, it means a diameter, in the case of an oval, it means any one of a major axis and a minor axis or a mean value thereof, in the case of a square, it means a length of one side, and in the case of an oblong, it means any one of a height and a width or a mean value thereof.

If the wall thickness is too small, strength of the honeycomb substrate is lowered, and deformation sometimes occurs during the production process, transportation, filling or use of the honeycomb catalyst, though it depends upon the material of the substrate. If the wall thickness is too large, the substrate suffers disadvantages that the weight is extremely increased, economical efficiency is lowered, and the number of cells is decreased.

Further, a honeycomb substrate having a short length is inconvenient in use, and a honeycomb substrate having a long length makes it difficult to form a uniform fine particle layer. On this account, the performance cannot be sufficiently exerted occasionally.

As the shape of the conductive honeycomb substrate for use in the invention, a desired shape, such as cubic, cylindrical or corrugated shape, is adoptable. As the shape of the opening, any of various shapes, such as circle, triangle and rectangle, is adoptable.

In the present invention, a conductive substrate having depressions and protrusions on the surface is employable, but because the later-described fibrous fine particles are added to the metal oxide fine particles in the invention, the adhesion is excellent, and on this account, a conductive substrate having depressions and protrusions on the surface does not necessarily have to be used, or rather, there is no need for it. Therefore, the economical efficiency is excellent.

Dispersion

In the present invention, a dispersion of metal oxide fine particles and fibrous fine particles is employed.

Metal Oxide Fine Articles

As the metal oxide fine particles for use in the invention, useful metal oxide fine particles having adsorptivity, catalytic performance, electrical conduction properties, electrical conduction performance, etc. are employable. Above all, metal oxide fine particles of elements of the group IIA, the group IIIA, the group IVA, the group VA, the group VIA, the group VIIA, the group IIB, the group IIIB and the group VB are preferably employed. Specifically, metal oxide fine particles (including composite oxide fine particles) made of a metal oxide of one or more elements selected from Mg, Car Ba, La, Ce, Ti, Zr, V, Cr, Mo, W, Mn, Zn, Al, Si, P and Sb can be preferably employed.

The metal oxide fine particles have a mean particle diameter of preferably 10 nm to 5 μm, more preferably 20 nm to 1 μm. If the mean particle diameter is too small, shrinkage of a fine particle layer is violent when the fine particle layer is dried or calcined after formation of the fine particle layer, and cracks sometimes occur in the fine particle layer. If the mean particle diameter is too large, deposition of the fine particles in a layer form on the conductive substrate sometime becomes insufficient, or even if the fine particle layer is deposited, adhesion of the layer to the substrate sometimes becomes insufficient.

Fibrous Fine Articles

As the fibrous fine particles for use in the invention, fibrous metal oxide fine particles of a component similar to that described above are employable except for the particle shape. In this case, the component of the fibrous fine particles and the component of the metal oxide fine particles may be the same or different.

By the use of the fibrous fine particles together with the metal oxide fine particles, adhesion, strength and abrasion resistance are improved. Although the reason is not clear, the following can be considered. The fibrous fine particles come into line-contact or plane-contact with the substrate, but the metal oxide fine particles come into point-contact with the substrate. The fibrous fine particles are larger than the metal oxide fine particles, and in such a case, smaller fine particles are attracted to larger fine particles by the attractive force and adhere thereto relatively strongly. In the state where the fibrous fine particles are deposited on the substrate, striped grooves (depressions and protrusions) are formed, and in this case, adhesion is more enhanced than the case where a layer of the metal oxide fine particles is formed directly on a flat substrate.

Examples of the fibrous fine particles include fibrous silica, fibrous alumina and fibrous titanium oxide. The fibrous fine particles have a length of 50 nm to 10 μm, preferably 100 nm to 5 μm, a diameter of 10 nm to 2 μm, preferably 20 nm to 2 μm, and an aspect ratio (length/diameter) of 5 to 1,000, preferably 10 to 500. When the size of the fibrous fine particles is in the above ranger the resulting metal oxide fine particle layer not only has high adhesion to the substrate but also is excellent in strength and abrasion resistance.

When the fibrous fine particles have a short length, adhesion between the metal oxide fine particle layer formed and the substrate sometimes becomes insufficient even if the fine particles are fibrous, though it depends upon the diameter of the fibrous fine particles. When the length of the fibrous fine particles is too long, adhesion between the metal oxide fine particle layer formed and the substrate sometimes becomes insufficient probably because the fibrous fine particles are conspicuously entangled in one another.

Fibrous fine particles having a small diameter are insufficient in themselves in adhesion to the substrate, and the adhesion between the metal oxide fine particle layer formed and the substrate sometimes becomes insufficient probably because the depression/protrusion forming effect of the fibrous fine particles on the substrate is small. Fibrous fine particles having a large diameter are insufficient in themselves in adhesion to the substrate, and the adhesion between the metal oxide fine particle layer formed and the substrate sometimes becomes insufficient.

If the aspect ratio is low, adhesion between the metal oxide fine particle layer formed and the substrate sometimes becomes insufficient probably because the depression/protrusion forming effect attributable to the use of the fibrous fine particles is small. If the aspect ratio is too high, adhesion between the metal oxide fine particle layer formed and the substrate sometimes becomes insufficient because the fibrous fine particles are entangled in one another.

The amount of the fibrous fine particles used is in the range of preferably 0.1 to 20% by weight, more preferably 0.5 to 10% by weight, based of the weight of the metal oxide fine particles.

If the amount of the fibrous fine particles used is small, adhesion to the honeycomb substrate sometimes becomes insufficient. Even if the amount of the fibrous fine particles is too large, the fibrous fine particles only become excess fibrous fine particles, and the adhesion to the substrate or the strength is not further improved, or rather, the function or the performance of the metal oxide fine particle layer sometimes becomes insufficient because the proportion of the metal oxide fine particles is decreased.

Component of Dispersion

In the dispersion, colloidal particles having a mean particle diameter of 2 to 300 nm, preferably 5 to 100 nm, can be further used. The colloidal particles are not specifically restricted provided that they are particles whose surfaces have been electrostatically charged, and examples of such colloidal particles include colloidal particles of titanium oxide, alumina, silica, silica-alumina and zirconia.

If the dispersion contains such colloidal particles, deposition of the metal oxide fine particles in a layer form tends to be accelerated when a direct-current voltage is applied to deposit the metal oxide fine particles in a layer form, and the strength and the abrasion resistance of the metal oxide fine particle layer formed can be enhanced.

Even if the colloidal particles are the same as the metal oxide fine particles, they can be favorably employed.

If the mean particle diameter of the colloidal particles is small, the dispersion becomes unstable depending upon the type of the metal oxide fine particles used. If the mean particle diameter thereof is too large, the amount of the electrostatic charge on the colloidal particle surfaces is decreased. In either case, the effect that the colloidal particles adhere to the metal oxide fine particles to accelerate deposition of the metal oxide fine particles in a layer form and the effect that the colloidal particles bind the metal oxide fine particles to one another to enhance strength and abrasion resistance of the metal oxide fine particle layer sometimes become insufficient.

The amount of the colloidal particles used is in the range of preferably 0.1 to 20% by weight, more preferably 0.5 to 15% by weight, in terms of solids content, based on the total weight of the metal oxide fine particles and the fibrous fine particles. When the amount thereof is in such a range, the effect attributable to the use of the colloidal particles is exerted. If the amount of the colloidal particles used is less than 0.1% by weight in terms of solids content, based on the total weight of the metal oxide fine particles and the fibrous fine particles, the effect of accelerating deposition in a layer form is insufficient, and the effect of enhancing strength and abrasion resistance of the metal oxide fine particle layer formed is insufficient.

If the amount of the colloidal particles used is exceeds 20% by weight in terms of solids content, based on the total amount of the metal oxide fine particles and the fibrous fine particles, the effect of accelerating deposition in a layer form and the effect of enhancing strength and abrasion resistance of the metal oxide fine particle layer are not further enhanced, or rather, the function or the performance of the metal oxide fine particle layer sometimes becomes insufficient because the proportion of the metal oxide fine particles is decreased and probably because the metal oxide fine particles are covered with the colloidal particles.

Dispersion Medium

As a dispersion medium of the mixed dispersion which contains the metal oxide fine particles, the fibrous fine particles and the optionally used colloidal particles and is used in the invention, one or more substances selected from water, alcohols, ketones and glycols are employable. Examples of the alcohols include methanol, ethanol, isopropyl alcohol and butanol. Examples of the ketones include acetone. Examples of the glycols include ethylene glycol and propylene glycol.

Of these, aqueous dispersion media containing water and alcohols of relatively low-boiling point, such as methanol, ethanol, isopropyl alcohol and butanol, are preferably used because they can homogeneously disperse the fine particles, a binder component, a deposition accelerator, etc. and they are easily evaporated when the fine particle layer is formed on the substrate.

Composition of Dispersion

The solids concentration of the mixed dispersion of the metal oxide fine particles, the fibrous fine particles and the colloidal particles used when necessary is in the range of preferably 1 to 30% by weight, more preferably 2 to 20% by weight.

If the concentration is less than 1% by weight, a layer of a desired thickness cannot be deposited by one operation in some cases because of too low concentration, though it depends upon the area of the substrate surface on which the layer is deposited, so that the deposition operation needs to be repeated.

If the concentration exceeds 30% by weight, the viscosity of the dispersion is increased and the denseness of the fine particle layer is lowered, so that the strength and the abrasion resistance sometimes become insufficient.

Formation of Fine Particle Layer

In the method for forming a fine particle layer of the invention, the conductive substrate is immersed in the mixed dispersion of the metal oxide fine particles, the fibrous fine particles and the colloidal particles used when necessary, and a direct-current voltage is applied to the conductive substrate and the dispersion.

The applied voltage is in the range of preferably 0.5 to 100 V (DC), more preferably 1 to 50 V (DC), though it varies depending upon the type of the metal oxide fine particles, the type of the conductive substrate, etc.

If the applied voltage is less than 0.5 V (DC), deposition of the fine particles in a layer form becomes insufficient, and the fine particles are sometimes deposited in mottles or the deposition sometimes needs a long period of time.

If the applied voltage exceeds 100 V (DC), the denseness of the resulting fine particle layer is lowered, and the strength and the abrasion resistance sometimes become insufficient, though the deposition rate is high.

The voltage application time is in the range of approx. 1 to 60 minutes though it varies depending upon the type of the metal oxide fine particles, the amount thereof, etc.

After the fine particles are deposited in a layer form, the substrate with the deposited fine particle layer is taken out, then dried, and if necessary, subjected to heat treatment.

As the drying method, a hitherto publicly known method is adoptable. Air drying is also possible. Drying is carried out usually at 50 to 100° C. for 0.2 to 5 hours.

The heat treatment is carried out at usually 200 to 800° C., preferably 300 to 600° C., for approx. 1 to 48 hours. The atmosphere in the heat treatment varies depending upon the type of the fine particle layer, use purpose, etc., and an oxidizing gas atmosphere, a reducing gas atmosphere or an inert gas atmosphere can be properly selected.

On the thus obtained substrate on which the fine particle layer has been formed, a new component can be supported after the drying or the heat treatment.

Although the new component used varies depending upon the use purpose, examples of the new components include a metal component, an oxide component, a metal complex component, a precious metal component, a composite oxide component and a rare earth element component hitherto publicly known.

For example, when the metal component is supported, the substrate on which the fine particle layer has been formed is impregnated with a metal salt aqueous solution, then dried and subjected to heat treatment in a reducing atmosphere, whereby the substrate with the metal component can be obtained. Further, the substrate on which the fine particle layer has been formed is impregnated with a metal colloidal particle dispersion prepared in advance, then dried, and if necessary, subjected to heat treatment in a reducing atmosphere or an inert atmosphere, whereby the substrate with the metal component can be obtained. Moreover, the substrate on which the fine particle layer has been formed is immersed in a metal salt aqueous solution, then a reducing agent is added to deposit a metal component, and the substrate is dried, and if necessary, subjected to heat treatment in a reducing atmosphere or an inert atmosphere, whereby the substrate with the metal component can be obtained.

When the oxide component is supported, the substrate on which the fine particle layer has been formed is impregnated with a metal salt aqueous solution, then dried and subjected to heat treatment in an oxidizing atmosphere, whereby the substrate with the oxide component can be obtained. Further, the substrate on which the fine particle layer has been formed is impregnated with a metal oxide colloidal particle dispersion prepared in advance, then dried, and if necessary, subjected to heat treatment in an oxidizing atmosphere, whereby the substrate with the oxide component can be obtained. Moreover, the substrate on which the fine particle layer has been formed is immersed in a metal salt aqueous solution, then a hydrolyzing agent for the metal salt is added to deposit a metal hydroxide, and the substrate is dried and subjected to heat treatment in an oxidizing atmosphere, whereby the substrate with the oxide component can be obtained.

The thickness of the fine particle layer formed as above is in the range of preferably 10 nm to 1 mm, more preferably 20 nm to 0.5 mm, though it depends upon the size of the particles. The thickness of the fine particle layer is by no means less than the mean particle diameter of the fine particles.

If the thickness of the fine particle layer is small, properties (adsorptivity, catalytic performance, electrical conduction properties, antifungal properties, etc.) of the fine particles are not exhibited sufficiently. If the thickness thereof is too large, formation of the fine particle layer is sometimes difficult in itself, or even if the fine particle layer is formed, adhesion of the layer to the substrate is sometimes insufficient, and besides, strength and abrasion resistance of the fine particle layer sometimes become insufficient.

EXAMPLES

The present invention is further described with reference to the following examples, but it should be construed that the invention is in no way limited to those examples.

Example 1

Preparation of Fibrous Fine Particles (1)

60 g of a rutile titanium powder (trade name: CR-EL, available from Ishihara Sangyo Kaisha, Ltd.) was mixed with 10 liters of a NaOH aqueous solution having a concentration of 40% by weight. This titanium oxide powder-mixed alkali aqueous solution was filled in an autoclave and subjected to hydrothermal treatment at 150° C. for 25 hours with stirring. Thereafter, the solution was cooled down to room temperature, subjected to filtration separation, washed by pouring 20 liters of 1N hydrochloric acid, then dried at 120° C. for 16 hours and calcined at 500° C. to prepare fibrous fine particles (1) of titanium oxide.

The fibrous fine particles (1) were measured on length (L), diameter (D) and aspect ratio (L/D). The results are set forth in Table 1.

Preparation of Metal Oxide Fine Articles (1)

In 3630 g of pure water were dissolved 329.5 g of a zirconium chloride aqueous solution (Zirconzol, available from Daiichi Kigenso Kagaku Kogyo Co., Ltd., $ZrO_2$ concentration: 25.1% by weight) and 260.6 g of cobalt nitrate (Kansai Chemical Co., Ltd., CoO concentration: 25.77% by weight) to prepare a mixed aqueous solution.

To an alkali aqueous solution obtained by dissolving 129.9 g of sodium hydroxide (available from Kanto Chemical Co., Inc.) in 11000 g of pure water, the above mixed aqueous solution was added over a period of 10 minutes with stirring the alkali aqueous solution at room temperature, whereby a mixed hydrogel of zirconium hydroxide and cobalt hydroxide was prepared.

Subsequently, the hydrogel was aged at 70° C. for 2 hours, and then, pH of the hydrogel was adjusted to 7.5 to 8 by the use of nitric acid having a concentration of 63% by weight. Thereafter, the hydrogel was filtered, washed, dried at 120° C. and then calcined at 500° C. for 2 hours to obtain a $ZrO_2$—CoO composite oxide.

Then, 100 g of the $ZrO_2$—CoO composite oxide was pulverized into particles having a mean particle diameter of 1.4 μm. This powder was allowed to absorb a ruthenium chloride aqueous solution obtained by dissolving 3.4 g of ruthenium chloride (available from Kojima Chemical Co., Ltd.) in 12.5 g of water and having a concentration of 5% by weight in terms of dissolved $RuO_2$, followed by drying at 120° C. for 16 hours. Thereafter, 100 g of the dry powder was dispersed in 1666 g of aqueous ammonia having a concentration of 5% by weight, stirred for 1 hour, then filtered, washed to remove chlorine and dried again at 120° C. for 16 hours to prepare metal oxide fine articles (1) as catalyst component for methanation. Composition of the metal oxide fine particles (1) is set forth in Table 1.

Preparation of Metal Oxide Fine Particle Dispersion (1)

In 500 g of pure water, 80 g of the metal oxide fine particles (1) were dispersed, and with stirring, to the dispersion were added 250 g of a titania sol (HPW-18NR, available from Catalysts & Chemicals Industries Co., Ltd., mean particle diameter: 18 nm, $TiO_2$ concentration: 10% by weight, dispersion medium: water) as colloidal particles and 20 g of the fibrous fine particles (1). Subsequently, the mixture was stirred for 30 minutes and then irradiated with ultrasonic waves for 20 minutes to prepare a metal oxide fine particle dispersion (1).

Preparation of Substrate (1) With Metal Oxide Fine Particle Layer

In a 500 ml glass beaker, 400 g of the metal oxide fine particle dispersion (1) was placed, and in this dispersion, a honeycomb substrate (available from Nippon Steel Corporation, outer diameter: 30 mm, length 50 mm, wall thickness: 30 μm, opening: 600 cpsi, made of SUS) was introduced as a negative pole, and a flat plate (5 cm×5 cm) made of SUS (same material as that of honeycomb substrate) was introduced as a positive pole. With stirring the metal oxide fine particle dispersion (1) by a magnetic stirrer, the positive pole and the negative pole were connected to a direct-current voltage device (model number: PAD35-10L, manufactured by Kikusui Electronics Corp.) serving as a direct-current power supply, by the use of a SUS line of 1 mm diameter, and a voltage of 15 V (DC) was applied for 2 minutes. The honeycomb substrate on which a fine particle layer had been formed was taken out, then dried at 120° C. for 3 hours and calcined at 500° C. for 2 hours to prepare a substrate (1) with a metal oxide fine particle layer.

The resulting substrate (1) with a metal oxide fine particle layer was evaluated on thickness of the fine particle layer, adhesion and uniformity of the fine particle layer. The results are set forth in Table 1.

The thickness of the fine particle layer, the adhesion and the uniformity of the fine particle layer were evaluated by the following methods and evaluation criteria.

Thickness of Fine Particle Layer

The honeycomb substrate sample (1) with the electrodeposited fine particle layer was fixed with an epoxy resin and cut in round slices with a metal sawing machine. The section of the resulting slice was polished and photographed by a scanning electron microscope (SEM, manufactured by Hitachi, Ltd.). On the photograph, the wall thickness was measured by a slide gauge, and the result is set forth in Table 1.

Adhesion

The catalyst layer electrodeposited on the outer surface of the honeycomb substrate was rubbed with the inner surface of the thumb, and the adhesion was evaluated by the following criteria.

AA: Any catalyst powder does not stick to the thumb at all.

BB: The catalyst powder sticks a little to the thumb.

CC: The evaluation is intermediate between BB and DD.

DD: When the catalyst layer is rubbed with the thumb, the catalyst powder peels off.

Uniformity of Fine Particle Layer

The SEM photograph was visually observed, and the film uniformity was evaluated by the following criteria.

AA: A uniform film of the catalyst was formed on the honeycomb substrate.

BB: The catalyst was partially ununiformly electrodeposited on the honeycomb substrate.

CC: The catalyst was electrodeposited in mottles on the honeycomb substrate.

DD: The catalyst was not electrodeposited on the honeycomb substrate.

Performance Evaluation

The substrate (1) with a metal oxide fine particle layer was allowed to undergo methanation reaction of CO in the following manner, and the catalytic performance was evaluated.

Catalytic Performance

A reaction tube of a fixed bed flow type reaction apparatus was charged with the substrate (1) with a metal oxide fine particle layer, and then, with allowing a hydrogen gas (mixed gas with 50% by volume of nitrogen) to flow, the substrate was reduced at 500° C. for 1 hour. Subsequently, the temperature was lowered down to 160° C., and a reaction gas (composition: Co: 5% by volume, $CO_2$: 20% by volume, $CH_4$: 2% by volume, $H_2$: balance) was allowed to flow so that SV would become 2000 $hr^{-1}$. After about 1 hour, the generated gas in the steady state was analyzed by gas chromatography and an infrared spectroscopic type gas concentration meter. A favorable result, namely a CO concentration of 10 ppm, was obtained.

Example 2

Preparation of Substrate (2) With Metal Oxide Fine Particle Layer

A substrate (2) with a metal oxide fine particle layer was prepared in the same manner as in Example 1, except that a voltage of 5 V (DC) was applied for 2 minutes.

The resulting substrate (2) with a metal oxide fine particle layer was evaluated on thickness of the fine particle layer, adhesion and uniformity of the fine particle layer. The results are set forth in Table 1.

Performance Evaluation

The substrate (2) with a metal oxide fine particle layer was allowed to undergo methanation reaction of CO in the same manner as in Example 1. A favorable result, namely a CO concentration of 30 ppm, was obtained.

Example 3

Preparation of Substrate (3) With Metal Oxide Fine Particle Layer

A substrate (3) with a metal oxide fine particle layer was prepared in the same manner as in Example 1, except that a voltage of 20 V (DC) was applied for 2 minutes.

The resulting substrate (3) with a metal oxide fine particle layer was evaluated on thickness of the fine particle layer, adhesion and uniformity of the fine particle layer. The results are set forth in Table 1.

Performance Evaluation

The substrate (3) with a metal oxide fine particle layer was allowed to undergo methanation reaction of CO in the same manner as in Example 1. A favorable result, namely a CO concentration of 5 ppm, was obtained.

Example 4

Preparation of Fibrous Fine Articles (4)

60 g of a rutile titanium powder (trade name: CR-EL, available from Ishihara Sangyo Kaisha, Ltd.) was mixed with 10 liters of a NaOH aqueous solution having a concentration of 40% by weight. This titanium oxide powder-mixed alkali aqueous solution was filled in an autoclave and subjected to hydrothermal treatment at 140° C. for 20 hours with stirring. Thereafter, the solution was cooled down to room temperature, subjected to filtration separation, washed by pouring 20 liters of 1N hydrochloric acid, then dried at 120° C. for 16 hours and calcined at 500° C. to prepare fibrous fine particles (4) of titanium oxide. The fibrous fine particles (4) were measured on length (L), diameter (D) and aspect ratio (L/D). The results are set forth in Table 1.

Preparation of Metal Oxide Fine Particle Dispersion (4)

A metal oxide fine particle dispersion (4) was prepared in the same manner as in Example 1, except that 20 g of the fibrous fine particles (4) were used.

Preparation of Substrate (4) With Metal Oxide Fine Particle Layer

A substrate (4) with a metal oxide fine particle layer was prepared in the same manner as in Example 1, except that the metal oxide fine particle dispersion (4) was used.

The resulting substrate (4) with a metal oxide fine particle layer was evaluated on thickness of the fine particle layer, adhesion and uniformity of the fine particle layer. The results are set forth in Table 1.

Performance Evaluation

The substrate (4) with a metal oxide fine particle layer was allowed to undergo methanation reaction of CO in the same manner as in Example 1. A favorable result, namely a CO concentration of 12 ppm, was obtained.

Example 5

Preparation of Fibrous Fine Particles (5)

60 g of a rutile titanium powder (trade name: CR-EL, available from Ishihara Sangyo Kaisha, Ltd.) was mixed with 10 liters of a NaOH aqueous solution having a concentration of 40% by weight. This titanium oxide powder-mixed alkali aqueous solution was filled in an autoclave and subjected to hydrothermal treatment at 150° C. for 50 hours with stirring. Thereafter, the solution was cooled down to room temperature, subjected to filtration separation, washed by pouring 20 liters of 1N hydrochloric acid, then dried at 120° C. for 16 hours and calcined at 500° C. to prepare fibrous fine particles (5) of titanium oxide. The fibrous fine particles (5) were measured on length (L), diameter (D) and aspect ratio (L/D). The results are set forth in Table 1.

Preparation of Metal Oxide Fine Particle Dispersion (5)

A metal oxide fine particle dispersion (5) was prepared in the same manner as in Example 1, except that 20 g of the fibrous fine particles (5) were used.

Preparation of Substrate (5) With Metal Oxide Fine Particle Layer

A substrate (5) with a metal oxide fine particle layer was prepared in the same manner as in Example 1, except that the metal oxide fine particle dispersion (5) was used.

The resulting substrate (5) with a metal oxide fine particle layer was evaluated on thickness of the fine particle layer, adhesion and uniformity of the fine particle layer. The results are set forth in Table 1.

Performance Evaluation

The substrate (5) with a metal oxide fine particle layer was allowed to undergo methanation reaction of CO in the same manner as in Example 1. A favorable result, namely a CO concentration of 8 ppm, was obtained.

Example 6

Preparation of Metal Oxide Fine Particle Dispersion (6)

A metal oxide fine particle dispersion (6) was prepared in the same manner as in Example 1, except that 80 g of the metal oxide fine particles (1) were dispersed in 500 g of isopropyl alcohol instead of 500 g of pure water.

Preparation of Substrate (6) With Metal Oxide Fine Particle Layer

A substrate (6) with a metal oxide fine particle layer was prepared in the same manner as in Example 1, except that the metal oxide fine particle dispersion (6) was used.

The resulting substrate (6) with a metal oxide fine particle layer was evaluated on thickness of the fine particle layer, adhesion and uniformity of the fine particle layer. The results are set forth in Table 1.

Performance Evaluation

The substrate (6) with a metal oxide fine particle layer was allowed to undergo methanation reaction of Co in the same manner as in Example 1. A favorable result, namely a CO concentration of 17 ppm, was obtained.

Example 7

Preparation of Metal Oxide Fine Particle Dispersion (7)

A metal oxide fine particle dispersion (7) was prepared in the same manner as in Example 1, except that 100 g of a titania sol was used as colloidal particles.

Preparation of Substrate (7) With Metal Oxide Fine Particle Layer

A substrate (7) with a metal oxide fine particle layer was prepared in the same manner as in Example 1, except that the metal oxide fine particle dispersion (7) was used.

The resulting substrate (7) with a metal oxide fine particle layer was evaluated on thickness of the fine particle layer, adhesion and uniformity of the fine particle layer. The results are set forth in Table 1.

Performance Evaluation

The substrate (7) with a metal oxide fine particle layer was allowed to undergo methanation reaction of CO in the same manner as in Example 1. A favorable result, namely a CO concentration of 10 ppm, was obtained.

Example 8

Preparation of Metal Oxide Fine Particle Dispersion (8)

A metal oxide fine particle dispersion (8) was prepared in the same manner as in Example 1, except that 600 g of a titania sol was used as colloidal particles.

Preparation of Substrate (8) With Metal Oxide Fine Particle Layer

A substrate (8) with a metal oxide fine particle layer was prepared in the same manner as in Example 1, except that the metal oxide fine particle dispersion (8) was used.

The resulting substrate (8) with a metal oxide fine particle layer was evaluated on thickness of the fine particle layer, adhesion and uniformity of the fine particle layer. The results are set forth in Table 1.

Performance Evaluation

The substrate (8) with a metal oxide fine particle layer was allowed to undergo methanation reaction of CO in the same manner as in Example 1. A favorable result, namely a CO concentration of 8 ppm, was obtained.

Example 9

Preparation of Metal Oxide Fine Particles (9)

A hydrogenation catalyst (CDS-R2, available from Catalysts & Chemicals Industries Co., Ltd., $MoO_3$: 11.8% by weight, CoO: 2.9% by weight, $Al_2O_3$: 85.3% by weight, pellets 3 mm in diameter and 5 mm in length) was pulverized to prepare metal oxide fine particles (9) having a mean particle diameter of 1.4 μm.

Preparation of Metal Oxide Fine Particle Dispersion (9)

A metal oxide fine particle dispersion (9) was prepared in the same manner as in Example 1, except that the metal oxide fine particles (9) were used.

Preparation of Substrate (9) With Metal Oxide Fine Particle Layer

A substrate (9) with a metal oxide fine particle layer was prepared in the same manner as in Example 1, except that the metal oxide fine particle dispersion (9) was used.

The resulting substrate (9) with a metal oxide fine particle layer was evaluated on thickness of the fine particle layer, adhesion and uniformity of the fine particle layer. The results are set forth in Table 1.

Comparative Example 1

Preparation of Metal Oxide Fine Particle Dispersion (R1)

In 500 g of pure water, 80 g of the metal oxide fine particles (1) were dispersed. Subsequently, the dispersion was stirred for 30 minutes and then irradiated with ultrasonic waves for 20 minutes to prepare a metal oxide fine particle dispersion (R1).

Preparation of Substrate (R1) With Metal Oxide Fine Particle Layer

A substrate (R1) with a metal oxide fine particle layer was prepared in the same manner as in Example 1, except that the metal oxide fine particle dispersion (R1) was used.

The resulting substrate (R1) with a metal oxide fine particle layer was evaluated on thickness of the fine particle layer, adhesion and uniformity of the fine particle layer. The results are set forth in Table 1.

Performance Evaluation

The substrate (R1) with a metal oxide fine particle layer was allowed to undergo methanation reaction of CO in the same manner as in Example 1. The CO concentration was 200 ppm.

Comparative Example 2

Preparation of Metal Oxide Fine Particle Dispersion (R2)

In 500 g of pure water, 80 g of the metal oxide fine particles (1) were dispersed, and with stirring, 250 g of a titania sol (HPW-18NR, available from Catalysts & Chemicals Industries Co., Ltd., mean particle diameter: 18 nm, $TiO_2$ concentration: 10% by weight, dispersion medium: water) was added as colloidal particles. Subsequently, the mixture was stirred for 30 minutes and then irradiated with ultrasonic waves for 20 minutes to prepare a metal oxide fine particle dispersion (R2).

Preparation of Substrate (R2) With Metal Oxide Fine Particle Layer

A substrate (R2) with a metal oxide fine particle layer was prepared in the same manner as in Example 1, except that the metal oxide fine particle dispersion (R2) was used.

The resulting substrate (R2) with a metal oxide fine particle layer was evaluated on thickness of the fine particle layer, adhesion and uniformity of the fine particle layer. The results are set forth in Table 1.

Performance Evaluation

The substrate (R2) with a metal oxide fine particle layer was allowed to undergo methanation reaction of CO in the same manner as in Example 1. The CO concentration was 120 ppm.

Reference Example 1

Preparation of Fibrous Fine Particles (S1)

60 g of a rutile titanium powder (trade name: CR-EL, available from Ishihara Sangyo Kaisha, Ltd.) was mixed with 10 liters of a NaOH aqueous solution having a concentration of 40% by weight. This titanium oxide powder-mixed alkali aqueous solution was filled in an autoclave and subjected to hydrothermal treatment at 180° C. for 50 hours with stirring. Thereafter, the solution was cooled down to room temperature, subjected to filtration separation, washed by pouring 20 liters of 1N hydrochloric acid, then dried at 120° C. for 16 hours and calcined at 500° C. to prepare fibrous fine particles (S1) of titanium oxide. The fibrous fine particles (S1) were measured on length (L), diameter (D) and aspect ratio (L/D). The results are set forth in Table 1.

Preparation of Metal Oxide Fine Article Dispersion (S1)

In 500 g of pure water, 80 g of the metal oxide fine particles (1) were dispersed, and with stirring, to the dispersion were added 250 g of a titania sol (HPW-18NR, available from Catalysts & Chemicals Industries Co., Ltd., mean particle diameter: 18 nm, $TiO_2$ concentration: 10% by weight, dispersion medium: water) as colloidal particles and 20 g of the fibrous fine particles (S1). Subsequently, the mixture was stirred for 30 minutes and then irradiated with ultrasonic waves for 20 minutes to prepare a metal oxide fine particle dispersion (S1).

Preparation of Substrate (S1) With Metal Oxide Fine Particle Layer

A substrate (S1) with a metal oxide fine particle layer was prepared in the same manner as in Example 1, except that the metal oxide fine particle dispersion (S1) was used.

The resulting substrate (S1) with a metal oxide fine particle layer was evaluated on thickness of the fine particle layer, adhesion and uniformity of the fine particle layer. The results are set forth in Table 1.

Performance Evaluation

The substrate (S1) with a metal oxide fine particle layer was allowed to undergo methanation reaction of CO in the same manner as in Example 1. The CO concentration was 50 ppm.

TABLE 1

| | Metal oxide fine particles | | | | | | | Fibrous fine particles | | | |
|---|---|---|---|---|---|---|---|---|---|---|---|
| | Metal oxide | | | | | | Mean particle | | | Aspect | |
| | $ZrO_2$ wt % | CoO wt % | $MoO_3$ wt % | $Al_2O_3$ wt % | RuO wt % | Content wt % | diameter μm | Length: L μm | Diameter: D μm | ratio L/D | Content wt % |
| Ex. 1 | 42.7 | 52.5 | — | — | 5.0 | 94.7 | 1.4 | 3 | 0.05 | 60 | 2.4 |
| Ex. 2 | 42.7 | 52.5 | — | — | 5.0 | 94.7 | 1.4 | 3 | 0.05 | 60 | 2.4 |
| Ex. 3 | 42.7 | 52.5 | — | — | 5.0 | 94.7 | 1.4 | 3 | 0.05 | 60 | 2.4 |
| Ex. 4 | 42.7 | 52.5 | — | — | 5.0 | 94.7 | 1.4 | 0.5 | 0.03 | 17 | 2.4 |
| Ex. 5 | 42.7 | 52.5 | — | — | 5.0 | 94.7 | 1.4 | 8 | 0.06 | 133 | 2.4 |
| Ex. 6 | 42.7 | 52.5 | — | — | 5.0 | 94.7 | 1.4 | 3 | 0.05 | 60 | 2.4 |
| Ex. 7 | 42.7 | 52.5 | — | — | 5.0 | 96.2 | 1.4 | 3 | 0.05 | 60 | 2.4 |
| Ex. 8 | 42.7 | 52.5 | — | — | 5.0 | 92.6 | 1.4 | 3 | 0.05 | 60 | 2.4 |
| Ex. 9 | — | 2.9 | 11.8 | 85.3 | — | 94.7 | 1.4 | 3 | 0.05 | 60 | 2.4 |
| Comp. Ex. | 42.7 | 52.5 | — | — | 5.0 | 100 | 1.4 | — | — | — | — |
| Comp. Ex. | 42.7 | 52.5 | — | — | 5.0 | 97.1 | 1.4 | — | — | — | — |
| Ref. Ex. 1 | 42.7 | 52.5 | — | — | 5.0 | 94.7 | 1.4 | 13 | 0.06 | 217 | 2.4 |

| | Colloidal particles | | | | | | Fine particle layer | | | Catalytic |
|---|---|---|---|---|---|---|---|---|---|---|
| | | Mean particle | | | Applied | | Thick- | | | performance |
| | Type | diameter nm | Content wt % | Solvent Type | Voltage V | Time min | ness μm | Adhe-sion | Unifor-mity | 160° C.-CO ppm |
| Ex. 1 | titania | 18 | 2.9 | water | 15 | 2 | 20 | AA | AA | 10 |
| Ex. 2 | titania | 18 | 2.9 | water | 5 | 2 | 15 | AA | AA | 30 |
| Ex. 3 | titania | 18 | 2.9 | water | 20 | 2 | 40 | AA | AA | 5 |
| Ex. 4 | titania | 18 | 2.9 | water | 15 | 2 | 20 | AA | AA | 12 |
| Ex. 5 | titania | 18 | 2.9 | water | 15 | 2 | 20 | AA | AA | 8 |
| Ex. 6 | titania | 18 | 2.9 | IPA | 15 | 2 | 25 | BB | CC | 17 |
| Ex. 7 | titania | 18 | 1.4 | water | 15 | 2 | 20 | AA | AA | 13 |
| Ex. 8 | titania | 18 | 5.0 | water | 15 | 2 | 30 | AA | AA | 8 |
| Ex. 9 | titania | 18 | 2.9 | water | 15 | 2 | 10 | BB | CC | — |
| Comp. Ex. | — | — | — | water | 15 | 2 | 10 | DD | DD | 200 |
| Comp. Ex. | titania | 18 | 2.9 | water | 15 | 2 | 20 | CC | DD | 120 |
| Ref. Ex. 1 | titania | 18 | 2.9 | water | 15 | 2 | 20 | CC | DD | 50 |

The invention claimed is:

1. A method for forming a metal oxide particle layer on a conductive substrate, comprising immersing a conductive substrate in a dispersion of metal oxide particles and fibrous particles and applying a direct-current voltage to the conductive substrate and the dispersion, wherein the fibrous particles have a length (L) of 50 nm to 10 μm, a diameter (D) of 10 nm to 2 μm and an aspect ratio (L)/(D) of 5 to 1,000 and the content of the fibrous particles in the dispersion is in the range of 0.1 to 20% by weight in terms of solids content, based on the metal oxide particles.

2. The method for forming a metal oxide particle layer as claimed in claim 1, wherein the dispersion further contains colloidal particles having a mean particle diameter of 2 to 300 nm.

3. The method for forming a metal oxide particle layer as claimed in claim 2, wherein the content of the colloidal particles is in the range of 0.1 to 20% by weight in terms of solids content, based on the metal oxide particles.

4. The method for forming a metal oxide particle layer as claimed in claim 1, wherein the metal oxide particles comprise an oxide of one or more metals selected from the group consisting of Mg, Ca, Ba, La, Ce, Ti, Zr, V, Cr, Mo, W, Mn, Zn, Al, Si, P and Sb and have a mean particle diameter of 10 nm to 5 μm.

5. The method for forming a metal oxide particle layer as claimed in claim 1, wherein the particle layer has a thickness of 10 nm to 1 mm.

6. The method for forming a metal oxide particle layer as claimed in claim 1, wherein the dispersion medium of the dispersion is one or more substances selected from water, alcohols, ketones, glycols and organic acids.

7. The method for forming a metal oxide particle layer as claimed in claim 1, wherein the dispersion has a solids concentration of 1 to 30% by weight.

* * * * *